US007881484B2

(12) United States Patent
Gorelik et al.

(10) Patent No.: US 7,881,484 B2
(45) Date of Patent: Feb. 1, 2011

(54) CAPACITOR MICROPHONE

(75) Inventors: Vladimir Gorelik, Hannover (DE); Eckhard Welker, Wietze (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 821 days.

(21) Appl. No.: 11/597,006

(22) PCT Filed: May 19, 2005

(86) PCT No.: PCT/EP2005/005428

§ 371 (c)(1),
(2), (4) Date: Jul. 5, 2007

(87) PCT Pub. No.: WO2005/115052

PCT Pub. Date: Dec. 1, 2005

(65) Prior Publication Data

US 2007/0242847 A1 Oct. 18, 2007

(30) Foreign Application Priority Data

May 19, 2004 (DE) ..... 10 2004 024 729

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/174; 381/369

(58) Field of Classification Search ..... 381/174
See application file for complete search history.

(56) References Cited

U.S. PATENT DOCUMENTS

| | | | | |
|---|---|---|---|---|
| 6,078,677 | A * | 6/2000 | Dolleman et al. | 381/418 |
| 2002/0154790 | A1 | 10/2002 | Steeman et al. | |

FOREIGN PATENT DOCUMENTS

| | | | |
|---|---|---|---|
| DE | 424130 | | 1/1926 |
| DE | 72035 | | 4/1970 |
| DE | 1 939 130 | | 6/1971 |
| DE | 2 445 687 | | 4/1975 |
| DE | 36 16 638 | | 12/1986 |
| DE | 38 52 156 | | 5/1995 |
| DE | 100 64 359 | | 7/2002 |
| EP | 305540 | A1 * | 3/1989 |

* cited by examiner

*Primary Examiner*—Curtis Kuntz
*Assistant Examiner*—Matthew Eason
(74) *Attorney, Agent, or Firm*—Frommer Lawrence & Haug LLP

(57) ABSTRACT

The present invention concerns a capacitor microphone comprising a microphone housing having a sound inlet opening, a diaphragm and a counterpart electrode which is associated with the diaphragm and which is arranged at a small spacing relative to the diaphragm. In order to be able to construct such a capacitor microphone with the smallest possible dimensions with at the same time a high signal-noise ratio and without worsening the electro-acoustic parameters, it is proposed in accordance with the invention that the microphone housing has two housing portions of which the second housing portion is of a larger diameter than the first housing portion and the second housing portion is arranged in the form of a cap or sleeve over the first housing portion and the edge of the diaphragm is folded over the edge of the first housing portion and fixed to the outside of the first housing portion.

13 Claims, 5 Drawing Sheets

CAPACITOR MICROPHONE

CROSS-REFERENCE TO RELATED APPLICATIONS

This application claims priority of International Application No. PCT/EP2005/005428, filed May 19, 2005 and German Application No. 10 2004 024 729.3, filed May 19, 2004, the complete disclosures of which are hereby incorporated by reference.

BACKGROUND OF THE INVENTION a) Field of the Invention

The invention concerns a capacitor microphone comprising a microphone housing having a sound inlet opening, a diaphragm and a counterpart electrode which is associated with the diaphragm and which is arranged at a small spacing relative to the diaphragm. The invention further concerns a corresponding process for the production of such a capacitor microphone.

b) Description of the Related Art

Several hundred million miniature capacitor microphones are produced yearly worldwide. In general those microphones are produced using stacking technology. The individual elements of the transducer which is used in that case, that is to say in particular a diaphragm ring with a diaphragm glued thereto, a spacer ring, the counterpart electrode and so forth are in that case simply stacked one upon the other in the microphone housing. Such a structure is admittedly particularly simple but it also suffers from deficiencies which make use thereof practically impossible for the production of high-grade microphones and particularly high-grade miniature microphones.

Firstly, stacking technology involves relatively high levels of scatter in terms of the electro-acoustic parameters. The permitted deviations in sensitivity and the frequency response from the reference value and the reference curve are generally in the region of ±3 dB and higher. Experience shows that, even with those generous tolerances, it is not possible to avoid rejects. As the result can only be detected after the capsules (that is to say the microphones) have already been assembled (generally flanged), the parts of the reject capsules can no longer be used. Not only the wage costs but also additional material costs are loaded on to the end product in that case. One of the most important causes of the scatter in respect of sensitivity and frequency responses is the unevenness of the individual parts. That concerns in particular the inside surface of the microphone housing, the diaphragm ring and the electret surface which serves as a reference surface for the air gap between the diaphragm and the counterpart electrode. Diaphragm stiffness is changed due to mechanical deformation of the diaphragm ring in the operation of assembling the capsule, and that in turn causes changes in the electro-acoustic parameters.

Secondly, the capsule in question has a very high stray capacitance which is formed by the capacitances between the counterpart electrode and the diaphragm ring and between the counterpart electrode and the microphone housing. In miniature microphones with a very small effective diaphragm area the stray capacitance gives rise to losses of 3-6 dB in sensitivity.

Thirdly the spacer ring of plastic film often has a burr. That is the cause of the air gap no longer corresponding to its nominal value.

Fourthly the use of the diaphragm ring leads to a reduction in the oscillatable diaphragm area. Thus the oscillatable diaphragm area in miniature microphones frequently constitutes only half the cross-sectional area of the capsule, which gives rise to considerable losses in the dynamic range of the microphone. US No 2002/01-54790 A1 discloses a capacitor microphone in which the diaphragm is adhesively fixed to the underside of a holding ring provided with a sound inlet opening. There, the ratio of oscillatable area of the diaphragm to the total cross-sectional area of the capacitor microphone (assuming a thin housing outer wall in the region of 0.1 mm) is $(1.9/2.5)^2=0.76^2=0.57$.

DE 3616638 C2, DE 10064359 A1, DE 3852156 T2, DE 2445687 B2 and DD 72 035 also disclose capacitor microphones in which the diaphragm is fixed to a part of the microphone housing. particular that the way in which the diaphragm is fixed to the microphone housing has an influence on the width of the air gap between the diaphragm and the counterpart electrode, which however should maintain a value which is as accurate as possible. Thus for example when fixing by means of an adhesive is involved, it is scarcely possible to set exact flatness of the diaphragm and an air gap between the diaphragm and the counterpart electrode of an exact width, by virtue of the thickness of the adhesive layer, which cannot be exactly predicted.

OBJECT AND SUMMARY OF THE INVENTION

The primary object of the invention is to provide an improved capacitor microphone and an improved process for the production of a high-grade miniature capacitor microphone, whereby the above-described disadvantages are to be avoided and in particular a high signal-noise ratio can be achieved. In addition the invention seeks to provide that the relationship between the oscillatable diaphragm area and the total area of the cross-section of the capacitor microphone is as great as possible and the provided air gap width between the diaphragm and the counterpart electrode or the electret layer which is mostly provided is as exact as possible.

According to the invention, in a capacitor microphone as set forth in the opening part of this specification, those objects are attained in that the microphone housing has two housing portions of which the second housing portion is of a larger diameter than the first housing portion and the second housing portion is arranged in the form of a cap or sleeve over the first housing portion and that the edge of the diaphragm is folded over the edge of the first housing portion and fixed to the outside of the first housing portion.

A corresponding process in accordance with the invention comprises the following steps:

a) a counterpart electrode is arranged in the first housing portion in such a way that there is a predetermined spacing in the axial direction between the top side of the counterpart electrode and the edge of the first housing portion;

b) a diaphragm associated with the counterpart electrode is laid over the edge of the housing portion;

c) the edge of the diaphragm is folded over the edge of the first housing portion;

d) the folded-over edge is fixed at the outside of the first housing portion; and e) the second housing portion is arranged as a cap or sleeve over the first housing portion.

In that respect the invention is based on the realization that the proposed direct fixing of the diaphragm to the first housing portion of the microphone housing renders the use of the diaphragm ring which was usually employed totally superfluous, and that entails a series of advantages. Thus as a result almost the entire cross-sectional area of the microphone housing can be effectively utilised so that the microphone housing and therewith the entire microphone can also be of a smaller structure. At the same time that arrangement also provides that it is possible to achieve a higher signal-noise ratio and improved electro-acoustic properties as the maximum possible diaphragm area is utilised and can oscillate freely.

In accordance with the invention the diaphragm is laid and folded over the upper edge of the first housing portion which is virtually in the form of a thin-walled tube portion which is open to the sound inlet opening provided in the second housing portion. The second housing portion is then virtually fitted in the form of a protective or decorative cap or sleeve over the first housing portion and joined thereto at suitable locations, for example also welded, glued or soldered. Alternatively the second housing portion is also in the form of a tube portion and a housing cover is also placed over the diaphragm so that the connecting location between the diaphragm and the first housing portion is covered over.

Particularly by virtue of improved technical possible ways of using microwelding and microadhesive, the invention can be used to produce miniature microphones for which there is an ever increasing need.

In particular the invention provides that the air gap width can be exactly maintained as fixing of the diaphragm to the microphone housing is effected at a location where an adhesive, welding or solder layer has no influence on the air gap width. In addition, at that point, that is to say on the outer peripheral surface of the tube portion, there is sufficient space for fixing the diaphragm without the oscillatable area of the diaphragm having to be reduced. The wall thickness of the first and second housing portions can thus also be selected to be extremely small.

Preferred configurations of the capacitor microphone according to the invention are set forth in the appendant claims. Preferably the diaphragm is welded or glued directly to the outside of the first housing portion. Glueing is preferably employed.

A development provides that an air gap is provided between the outside of the first housing portion and the inside of the second housing portion. That air gap affords sufficient space to mount, for example by adhesive, the folded-over diaphragm at that location to the outside of the first housing portion. Even if in that case the folded-over diaphragm layer forms folds and thus for example irregular raised portions are formed in that region, that has no influence on the air gap width between the diaphragm and the counterpart electrode or the electret layer, and the air gap between the first and second housing portions also affords sufficient space for that.

The air gap width is also preferably of such a dimension that a conductive connection is afforded between a conductive layer of the diaphragm which—in the folded—over portion of the diaphragm—faces towards the inside of the second housing portion, and the inside of the second housing portion. It will be noted however that the air gap width should be so great that the diaphragm can be adequately well positioned and that the folded-over region of the diaphragm is not damaged. Alternatively the air gap width can also be of such a dimension that the folded-over region of the diaphragm does not contract the inside of the second housing portion. A conductive connection between the diaphragm and the housing is then made at another location, for example between a housing cover and the diaphragm at a location where the diaphragm is clamped between the housing cover and the first housing portion.

A development of the invention provides that the counterpart electrode is arranged on a first circuit board fixed to the microphone housing or on an insulating portion fixed to the microphone housing. That circuit board thus serves as a carrier for the counterpart electrode and an electret layer which is optionally provided. The first circuit board is preferably also directly fixedly connected to the microphone housing, preferably glued, welded or soldered. The electret is then charged up. It is only thereafter that the diaphragm: is fitted to the microphone housing. In that case the first circuit board is fitted to the microphone housing in such a way that the desired air gap is formed.

It is also preferably provided that fitted in the microphone housing is a second circuit board having a circuits arrangement for signal processing, which is electrically connected to the counterpart electrode by means of electrical connecting means. That configuration is quite simple from the point of view of production procedure as firstly the first circuit board with the counterpart electrode is mounted in the first housing portion, then the diaphragm and finally the second circuit board is mounted in the microphone housing. In that case the first housing portion can simultaneously perform the function of a spacer element for adjusting the distance between the first and second circuit boards so that it is possible to dispense with a separate spacer element.

The counterpart electrode can also be arranged on the surface of the first circuit board.

It is also preferably provided that the diameter of the counterpart electrode is less than the diameter of the diaphragm. In that case the circuit board surface which is not covered over by the counterpart electrode can serve as a reference surface for the dimensioning of the air gap.

In a further configuration it is provided that the insulating portion is not connected in its entire peripheral region to the microphone housing so that at least one gap which serves for the discharge flow of air is formed between the edge of the insulating portion and the inside wall of the microphone housing. That improves the oscillation capability of the diaphragm at the outer edge.

In known capacitor microphones the diaphragm which as the carrier layer has a non-conductive film layer, for example consisting of a plastic material, is provided only on one side of the carrier layer with a conductive layer portion, for example a thin gold layer portion. In that case the diaphragm is then arranged in the capacitor microphone in such a way that either the conductive layer is in opposite relationship to the counterpart electrode (with the electret layer possibly applied thereto), as is disclosed for example in US No 2002/01547890, or the conductive layer is in opposite relationship to the sound inlet opening.

In the design in which the conductive layer is in opposite relationship to the sound inlet opening however there is the disadvantage that the non-conduct carrier layer of the diaphragm is placed between the counterpart electrode (or the electret layer) and the conductive layer of the diaphragm, which has an influence on the capacitance formed between the conductive layer of the diaphragm and the counterpart electrode (or the electret layer), and thus has an influence on the acoustic properties of the microphone. Furthermore, the conductive layer in this embodiment must be somehow conductively connected to the housing which is at reference potential, and that is generally effected by glueing to a housing ring or to an annular projection on the housing cover, in which case the adhesive (which with sufficiently good conductivity does not have good adhesive properties) then also has a detrimental effect on the conductivity of that join.

The first configuration in which the conductive layer is in opposite relationship to the counterpart electrode frequently has contact problems. Design configurations for example are known in which the diaphragm with the non-conductive carrier layer is fixed by adhesive on to a ring. In order to provide a conductive connection in conductive connection. It is however very complicated ed and expensive for tongues of that kind to be produced and correctly positioned.

To eliminate those disadvantages, a further configuration provides that the diaphragm has a conductive layer on both sides. Accordingly, in the case of the connection according to the invention, possibly by glueing, between the diaphragm and the first housing portion, which is possibly implemented by glueing, a conductive connection which is independent of the mechanical connection, at least of one of the conductive layers of the diaphragm to a housing portion which is at reference potential can be achieved. For example, adhesive can be provided only in a small region of the folded-over edge of the diaphragm so that the remaining edge region of the diaphragm is directly in contact with the outside of the first housing portion. Furthermore the air gap between the first and second housing portions can also be dimensioned in such a way that the folded-over edge of the diaphragm touches the inside of the second housing portion in order thereby to afford a conductive connection.

Admittedly, in such a configuration of the diaphragm, an additional capacitance is formed between the two conductive layers. That additional capacitance however is so great in relation to the capacitance, which is significant in terms of signal production, as between the diaphragm and the counterpart electrode or electret layer, that it has no effects on the acoustic properties of the capacitor electrode.

The invention is described in greater detail hereinafter with reference to the drawings.

DESCRIPTION OF THE PREFERRED EMBODIMENTS

Figure 1:
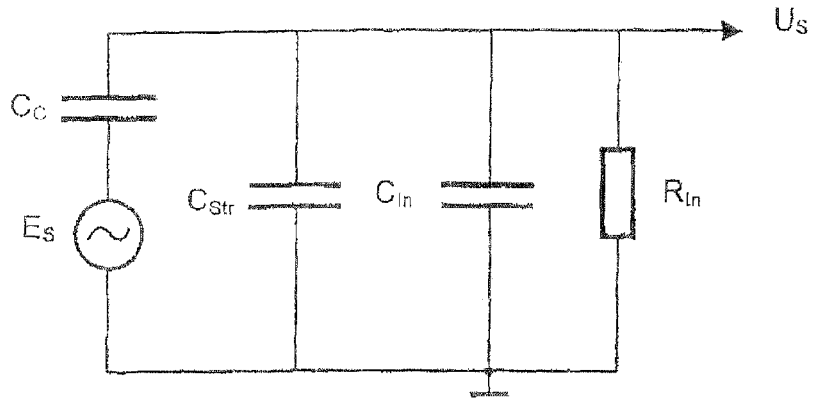
FIG. 1 shows a circuit diagram of an equivalent signal circuit of a capacitor microphone.

One of the most important parameters, of capacitor microphones—signal-noise ratio or equivalent sound level—is in particular dependent on the useful or stray capacitance of of the capsule as well as the input capacitance and the noise properties of the impedance transducer. That can be described with reference to FIG. 1 showing the circuit diagram of an equivalent signal circuit of a capacitor microphone. The tower the useful capacitance of the capsule $C_C$ in comparison with the total of the stray capacitance $C_{Str}$ and the input capacitance $C_{In}$ the correspondingly lower becomes the transmission factor $C=U_S/E_S$ ($E_S$ is here the capsule sensitivity in the no-load mode and $U_S$ is the output signal), and the correspondingly worse the signal-noise ratio also becomes. In that respect the influence of the input resistance on C is negligibly low as the condition $$R >> \frac{1}{\omega_N(C_{Str} + C_{In})}$$

($\omega_N$=lowermost limit of the operating frequency range) should always be satisfied in the case of the capacitor microphones.

The noise in relation to capacitor microphones is composed of thermal noise of the input resistance, molecular noise of the capsule and inherent noise of the impedance transducer. The first two components are determining aspects in regard to the signal-noise ratio of the microphone. Those components are particularly high in the case of miniature microphones with a small surface area for the diaphragm as molecular noise is inversely proportional to the radius of the diaphragm.

Figure 2:
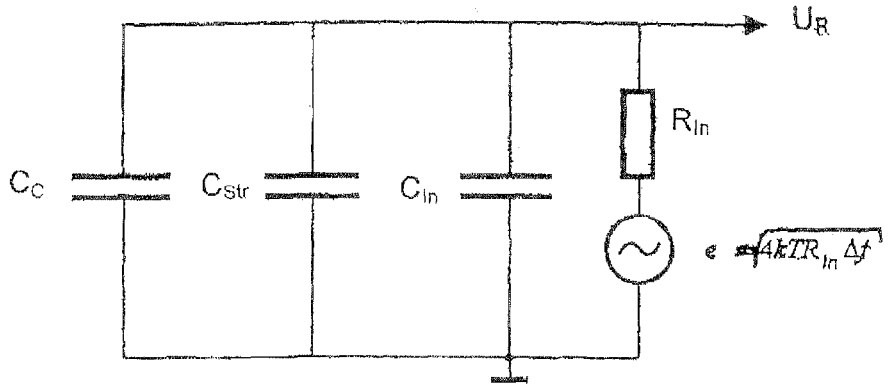
FIG. 2 shows a circuit diagram of an equivalent signal circuit for thermal noise.

FIG. 2 shows a circuit diagram of an equivalent circuit for calculating the thermal noise of the input resistance. Therein k denotes the Boltzmann's constant, T denotes the temperature in Kelvin and $\Delta f$ denotes the bandwidth in Hz. It can be seen from this circuit that the transmission factor $$K_R = \frac{U_R}{e}$$

(e is here the thermal noise of the resistance), for the noise voltage $U_R$, is frequency-dependent and increases with decreasing capacitances $C_C$, $C_{Str}$ and $C_{In}$.

The foregoing considerations show that the high signal-noise ratio in the case of miniature capacitor microphones can be achieved only at the maximum possible freely oscillating diaphragm surface area.

Figure 3:
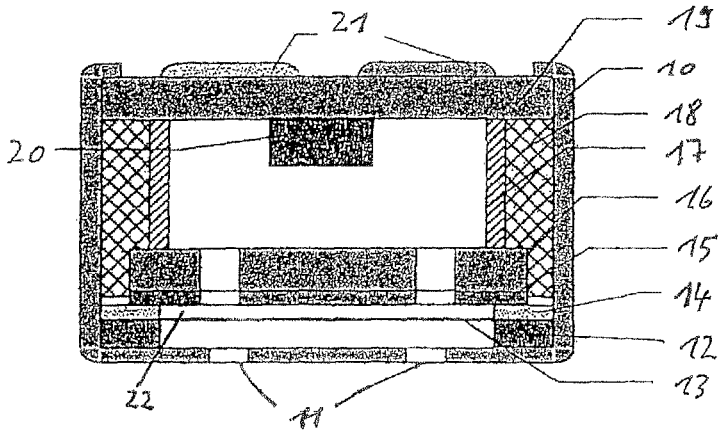
Fig. 3 (Prior Art)
FIG. 3 shows a cross-section through a known capacitor microphone.

FIG. 3 shows a cross-section through a known capacitor microphone which is produced in many cases in an identical or similar fashion. Provided within the microphone housing 10 having a sound inlet opening 11 are the following elements: a diaphragm ring 12, a diaphragm 13 which is fixed by adhesive on the diaphragm ring 2, a spacer ring 14, an electret film 15, a counterpart electrode 16 connected thereto, a contact ring 17, an insulating portion 18, and a circuit board 19 with a circuit arrangement 20 mounted thereon (in particular an IC) and with connecting contacts 21. The air gap 22 between the diaphragm 13 and the electret film 15 or the counterpart electrode 16 is defined in that case by the spacer ring 14. The individual elements of the transducer, that is to say the diaphragm ring 12 with the diaphragm 13 fixed-thereon by adhesive, the spacer ring 14 and so forth are in that case simply stacked one upon the other in the microphone housing 10 using stacking technology.

Such a structure however has a series of serious shortcomings so that such a microphone is not suitable in particular as a high-grade microphone, in particular a high-grade miniature microphone. In particular, as already mentioned in the opening part of this specification, the stacking technology employed leads to relatively high levels of scatter in terms of the electro-acoustic parameters, and that results in not inconsiderable levels of reject in manufacture. That is caused in particular due to the unevenness of individual components, in particular the surfaces thereof. Furthermore the stiffness of the diaphragm 13 can be altered by mechanical deformation of the diaphragm ring 12 when assembling the microphone, and that also causes changes in the electro-acoustic parameters.

In addition such a microphone has a high stray capacitance, which when the effective diaphragm area is very small, results in marked losses in sensitivity. In addition, because of thickness variations or because of a burr which is often present, the spacer ring can also result in deviations in the intended value of the air gap. Finally the use of the diaphragm ring 12 reduces the size of the diaphragm surface area which is capable of oscillation and which can be effectively used, often by up to 50%, and for that reason either the microphone has to be overall of larger dimensions or considerable losses in the dynamic range have to be accepted.

In the case of the known electret capsule OB 22L from Primo the diameter of the capsule is 6 mm and the inside diameter of the diaphragm ring is 3.7 mm so at only 38% of the total area of the diaphragm can be used as an oscillatable diaphragm area.

Figure 4:
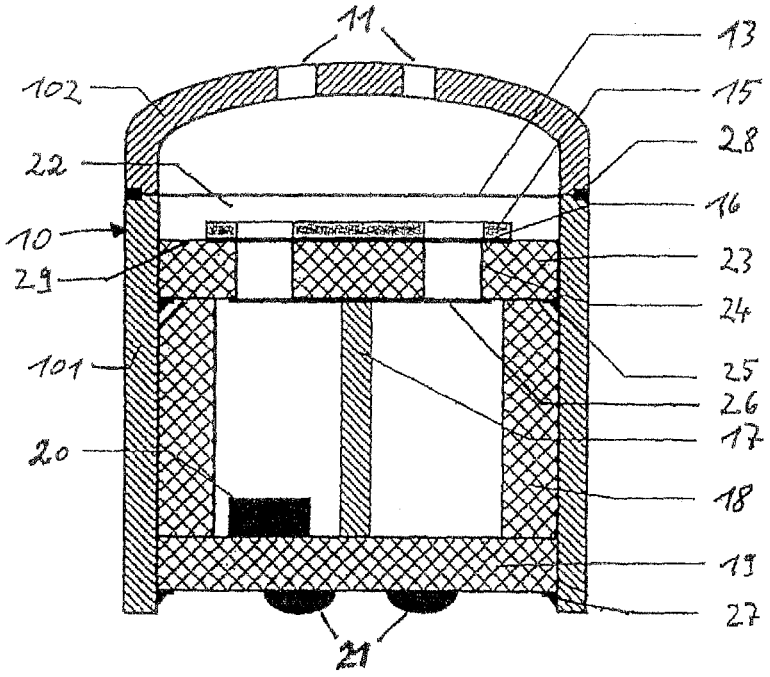
Fig. 4 (Prior Art)
FIG. 4 shows a cross-section through an embodiment of a known capacitor microphone.

A further configuration of a known capacitor microphone is shown in cross-section FIG. 4. In this case the microphone housing 10 comprises two portions, namely a first housing portion 101 and a second housing portion 102 which are both of an identical inside diameter. A first circuit board 23 whose surface which is towards the diaphragm 13 carries a thin counterpart electrode 16 and the electret layer 15 (partially or over the entire surface area thereof) is fixed in the first housing portion 101 in such a way that the electret surface and the housing edge form the desired air gap 22 towards the diaphragm 13. Fixing of the first circuit board 23 can be effected for example by microwelding a copper ring on the circuit board at weld spots 25 to the first housing portion 101. In addition provided in the first circuit board 23 is a through-contacting means 24 for galvanically connecting the counterpart electrode 16 to the contact region 26 on the underside of the first circuit board 23.

In addition in the lower region of the first housing portion 101 the second circuit board 19 with the circuit arrangement 20 and the contacts 21 is mounted fixedly to the first housing portion 101, preferably welded to the first housing portion 101 at weld spots or weld seams 27. The position of that circuit board 19 is determined by the dielectric spacer element 18. The connecting element 17 together with the contact region 26 and the through-contacting means 24 provides for the galvanic contact between the counterpart electrode 16 and the circuit arrangement 22. In that case the connecting element 17 can be for example in the form of a contact spring.

In this embodiment the diaphragm 13 is arranged between the two housing portions 101, 102 and welded at the outer edge to the two housing portions 101, 102 (weld seam 28). That arrangement provides that the two housing portions 101, 102 are also welded together. For that purpose firstly the first circuit board 23 with the counterpart electrode 16 and the electret layer 15 is introduced into the first housing portion 101 so as to afford the desired air gap. The first circuit board 23 is then welded to the first housing portion 101 at weld spots 25. Thereafter, the diaphragm 13 is placed on the edge of the first housing portion 101, the second housing portion 102 is placed thereover and then the diaphragm 13 is welded to the two housing portions 101, 102 at the weld seams 28. Finally the spacer element 18, the connecting element 17 and the second circuit board 19 are introduced into the first housing portion 101 and fixed.

In addition the dead capacitance of the capsule in this solution is extremely low as a diaphragm ring which is present in the known capacitor microphones is completely omitted and the counterpart electrode 16 is of an extremely small thickness (that is to say no lateral surface). Preferably the counterpart electrode 16 can also be of a smaller diameter than the diaphragm 13, as is the case in the illustrated embodiment. That has the advantage that the peripheral region of the diaphragm 13 which is scarcely involved in the oscillations and which acts as an only unwanted dead capacitance is smaller. Calculations have shown that in that case the gain in sensitivity can be up to 2-3 dB. In addition the outer edge 29 of the surface of the circuit board 23 can serve as a reference surface for the dimensioning of the air gap.

Figure 5:
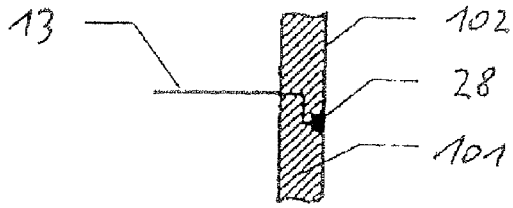
FIG. 5 shows a possible configuration of the connection between diaphragm and microphone housing.

FIG. 5 shows a modified embodiment for fixing of the diaphragm between the two housing portions 101, 102. Therein, the mutually facing edges of the two housing portions 101, 102 are in :the form of a complementary plug connection, between which the edge of the diaphragm 13 is laid and thus clamped in position before the welding operation is performed at the outer edge. In that case the plug connection can naturally also be of a different configuration from that shown in FIG. 5. Furthermore the diaphragm can also be welded directly to the inside of the first housing portion 101 or to the connecting location between the two housing portions 101, 102.

Figure 6:
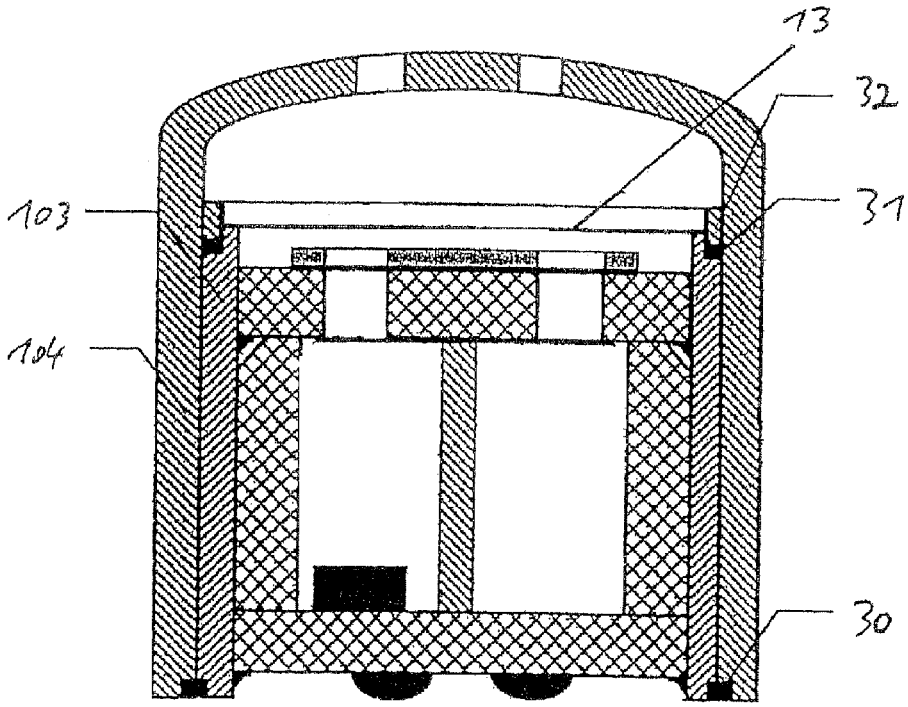
Fig. 6 (Prior Art)
FIG. 6 shows a cross-section through a further embodiment of a known capacitor microphone.

A further embodiment of a capacitor microphone is shown in FIG. 6. In this case the housing 10 also comprises two housing portions 103, 104, wherein the first housing portion 103 is in the form of a tube portion which is open at both ends and contains practically the entire transducer. The second housing portion 104 serves substantially as a protective and decorative cap and is welded to the first housing portion 103 at the weld seam 30. That configuration provides that the weld seam 31 for fixing the diaphragm 13 to the first housing portion 103 is covered over.

A further particularity in this embodiment is that the diaphragm 13 is clamped by means of a clamping ring 32 into a corresponding groove at the edge of the first housing portion 103 before it is welded there. In particular the diaphragm can be tensioned thereby. As the minimum necessary wall thickness for the housing portions in the microwelding operation is about 0.15-0.2 mm, the loss in area in this embodiment with the second housing portion 104 fitted externally over the first housing portion 103 is also very small.

Figure 7:
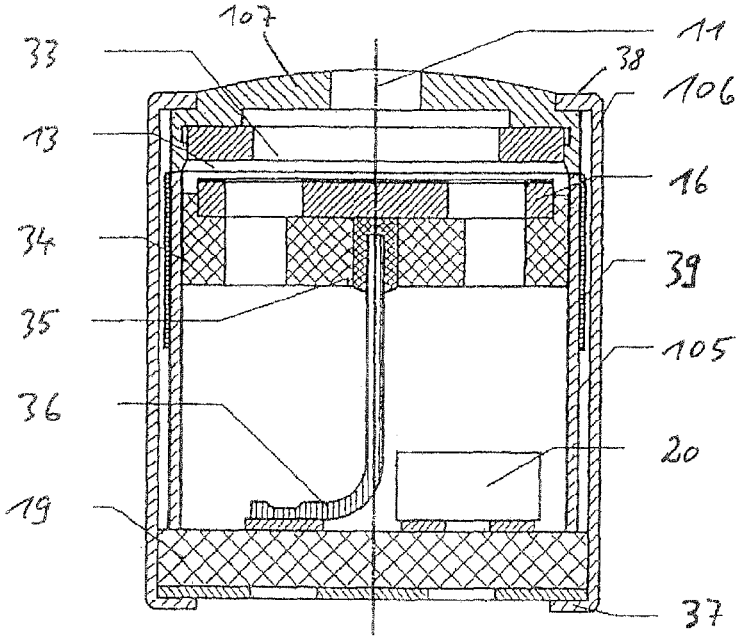
FIG. 7 shows a cross-section through an embodiment of a capacitor microphone according to the invention.

A preferred embodiment of a capacitor microphone according to the invention is shown in FIG. 7. The housing in turn comprises two housing portions 105, 106, wherein the first housing portion 105, similarly to the embodiment shown in FIG. 6, is in the form of a tube portion which is open at both ends and contains practically the entire transducer. The second housing portion 106 is in the form of a housing sleeve and serves substantially as a protective and decorative cladding for the first housing portion 103. At the upper and lower ends, the second-housing portion 106 has a respective flange edge 37, 38 of which one extends around the circuit board 19 (flange edge 37) and the other engages into or around a housing cover 107 (flange edge 38) in order to fix the second housing portion 106.

In this embodiment the diaphragm 13 is preferably glued to the first housing portion 105 in an adhesive region 39. For that purpose, preferably prior to assembly of the diaphragm 13 adhesive is applied in that adhesive region 39 to the first housing portion 105 from the outside. The diaphragm is then laid from above on the opening of the first housing portion 105, put under tension between the housing cover 107 and for example a further sleeve whose inside diameter is slightly greater than the outside diameter of the first housing portion 105, and then folded over so that the folded-over edges of the diaphragm 13 are glued in the adhesive region 39 to the outside of the first housing portion 105. That adhesive region 39 is then concealed by the second housing portion 106.

As an alternative, it is possible for that purpose to use an apparatus in which the diaphragm is tensioned between the first housing portion and the end of a pin. The sleeve first sits on the pin and is displaced downwardly for glueing the diaphragm in place.

The embodiment illustrated in FIG. 7 also has over the diaphragm a known protective diaphragm 33 for protecting the diaphragm 13 from moisture. Furthermore the counterpart electrode 16 in this embodiment is disposed on an insulating portion 34 which for example comprises plastic material. A connecting wire 36 to the circuit board 19 is fixed by means of a conductive adhesive 35 (or by means of a pressure contact spring) in the insulating portion 34 in the central region thereof.

A spacer element 17 as in the embodiments shown in FIGS. 4 and 5 is not required in this embodiment as the housing itself performs the function of the spacer element. In addition the housing cover 107 and the protective diaphragm 33 can also be in the form of a joint component.

In particular the solution according to the invention provides that the oscillatable region of the diaphragm area is very large in relation to the overall diameter of the capacitor microphone. With an inside diameter for the first housing portion 105 (=size of the oscillatable diaphragm area) of 2.8 mm, an outside diameter for the first housing portion 105 of 3 mm, an air gap width for the air gap between the first and second housing portions 105 and 106 of 0.05 mm (which is adequate with a diaphragm thickness of about 0.002-0.003 mm) and a wall thickness for the second housing portion 106 of 0.1 mm, that affords an outside diameter for the capacitor microphone of 3.3 mm so that the specified surface area ratio is $(2.8/3.3)^2=0.85^2=0.72$ and is thus markedly higher than in the case of the known capacitor microphones.

Furthermore in that case no adhesive layer influences the air gap width between the diaphragm 13 and the counterpart electrode 16 (or the electret layer applied thereto) which can thus be very precisely adjusted. Also, as much space can be taken up on the outside of the first housing portion as is necessary for the adhesive join, as the space taken up thereby also in fact has no influence on the size of the oscillatable region of the diaphragm. The wall thickness of the first housing portion 105 can therefore also be selected to be very thin and there are no contact problems.

Preferably the insulating portion 34 is fixed in the first housing portion 105 in such a way that an adhesive is introduced, for example at predetermined adhesive locations, at the underside of the insulating portion in the corner which extends therearound between the insulating portion 34 and the first housing portion 105.

The diaphragm 13 can be of differing configurations. A conductive layer is applied on a non-conducting carrier layer either only on one side (both above or below is a possibility) or on both sides.

If the conductive layer is applied only on top of the diaphragm, the conductive connection in relation to the housing which is at reference potential is established at least at the clamping location between the first housing portion and the housing cover 107 (more specifically, with the housing cover 107). If moreover the air gap between the first and second housing portions 105, 106 is very small, the folded-over edge of the diaphragm, with its outwardly facing conductive layer, can touch the second housing portion 106.

If the conductive layer is applied to the diaphragm only at the underneath, the conductive connection in relation to the housing which is at reference potential is established for example by a contact ring being provided on the circuit board 19 so that the conductive layer of the diaphragm can be electrically connected by way of the first housing portion 105 to that contact ring which can be connected to the second housing portion 106. Furthermore, adhesive can preferably not be provided in the entire adhesive region 39 so that the inwardly facing conductive layer of the folded-over edge of the diaphragm is in contact at least in a partial region with the outside of the first housing portion 105 directly (without adhesive therebetween).

If the conductive layer is applied to the diaphragm both on top and also underneath, all the above-described possible options are available.

Figure 8:
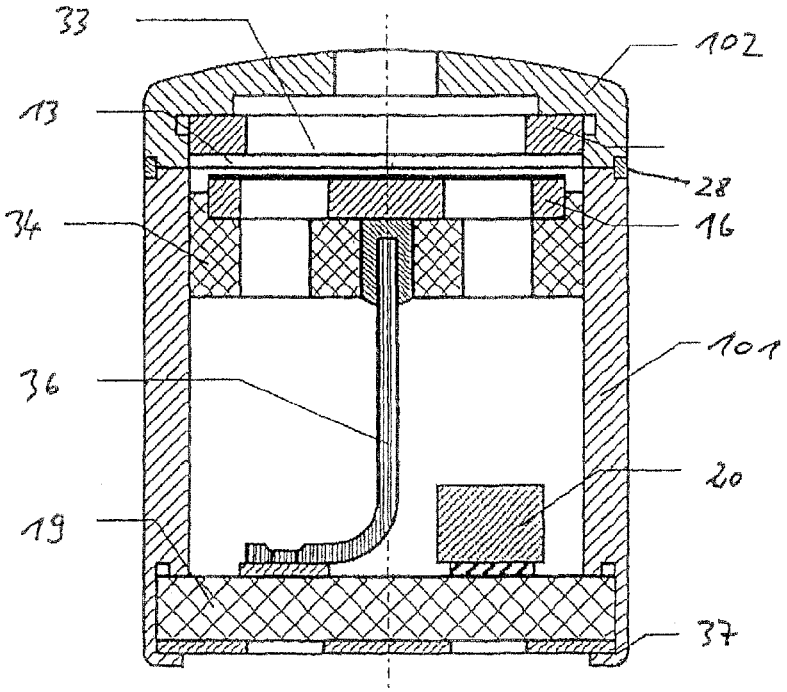
FIG. 8 shows a cross-section through a further embodiment of a capacitor microphone.

A further embodiment of a capacitor microphone is shown in FIG. 8. In this embodiment the diaphragm 13, as in the embodiment shown in FIG. 4, is inserted between the two housing portions 101 and 102 and welded thereto at the weld seam 28. Here too however the first housing portion 101 has a flange edge 37 at the lower edge for fixing the first housing portion 101. The housing itself therefore again performs the function of the spacer element which can again be eliminated. The insulating portion 34 and the counterpart electrode 16 are preferably in the form of a common unit which can also be assembled in a single process step.

Figure 9A:
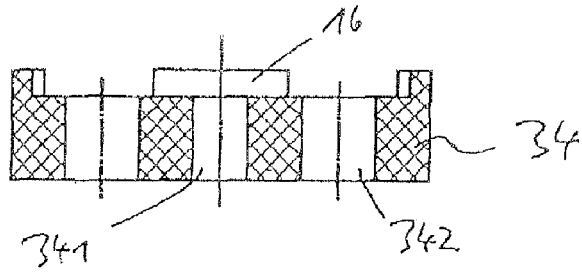
FIG. 9 shows an advantageous configuration of an insulating portion.
Figure 9B:
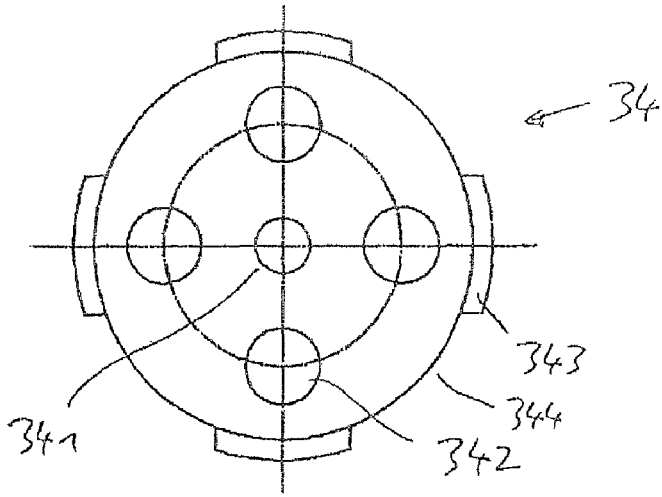

A preferred configuration of an insulating portion 34 is shown in FIG. 9, in cross-section in FIG. 9A and as a plan view in FIG. 9B. The Figures show four throughbores 342 which are distributed over the periphery and a central throughbore 341 provide to receive the conductive adhesive 35. It can also be seen from FIG. 9B that, in this embodiment, the insulating portion 34 does not have a round outside periphery but has outwardly extending portions 343 at a plurality of locations. Those outwardly extending portions 343 serve for fixing and centering the insulating portion within the housing. Between those outwardly extending portions, the insulating portion 343 in the regions 344 does not bear directly against the inside wall of the housing, but rather there is a gap between the insulating portion 34 and the housing. That gap improves the oscillation capability of the diaphragm at the edge thereof as that configuration ensures a better discharge flow of air upon oscillation of the diaphragm in those regions.

In accordance with the invention, therefore it is proposed that the microphone housing or parts of the microphone housing are used for fixing the diaphragm insofar as the edge of the diaphragm is folded over the edge of a first housing portion and fixed there on the outside. The use of a diaphragm ring which is usually employed and which reduces the area of the diaphragm which can be effectively utilized, or other fixing elements which are in one plane with the diaphragm, thus becomes redundant. The invention makes it possible to build miniature capacitor microphones which have a high signal-noise ratio while being of reduced While the foregoing description and drawings represent the present invention, it will be obvious to those skilled in the art that various changes maybe made therein without departing from the true spirit and scope of the present invention.

The invention claimed is:

1. A capacitor microphone comprising:

a microphone housing having a sound inlet opening;

a diaphragm; and a counterpart electrode which is associated with the diaphragm and which is arranged at a small spacing relative to the diaphragm;

said microphone housing having two housing portions of which the second housing portion is of a larger diameter than the first housing portion and the second housing portion being arranged in the form of a cap or sleeve over the first housing portion; and wherein an edge of the diaphragm is folded over an edge of the first housing portion and fixed to the outside of the first housing portion.

2. The capacitor microphone as set forth in claim 1, wherein the diaphragm is welded or glued to the outside of the first housing portion.

3. The capacitor microphone as set forth in claim 1, wherein there is an air gap between the outside of the first housing portion and the inside of the second housing portion.

4. The capacitor microphone as set forth in claim 3, wherein the air gap is of such a size that the edge of the diaphragm, which is fixed on the outside of the first housing portion, touches the inside of the second housing portion.

5. The capacitor microphone as set forth in claim 1, wherein the folded-over edge of the diaphragm is concealed by the second housing portion.

6. The capacitor microphone as set forth in claim 1, wherein the second housing portion is in the form of a sleeve and that the microphone housing further has a housing cover which covers over the oscillatable diaphragm area.

7. The capacitor microphone as set forth in claim 1, wherein the counterpart electrode is arranged on a first circuit board fixed to the microphone housing or on an insulating portion fixed to the microphone housing.

8. The capacitor microphone as set forth in claim 7, wherein mounted in the microphone housing is a second circuit board with a circuit arrangement for signal processing, which is electrically connected to the counterpart electrode by means of electrical connecting means.

9. The capacitor microphone as set forth in 7, wherein the diameter of the counterpart electrode is smaller than the diameter of the diaphragm.

10. The capacitor microphone as set forth in claim 7, wherein the insulating portion is not connected in its entire peripheral region to the microphone housing so that at least one gap serving for the discharge flow of air is formed between the edge of the insulating portion and the inside wall of the microphone housing.

11. The capacitor microphone as set forth in claim 1, wherein the diaphragm is coated on both sides with a conductive layer.

12. A process for the production of a capacitor microphone comprising a microphone housing having a sound inlet opening, wherein the microphone housing has two housing portions of which the second housing portion is of a larger diameter than the first housing portion, said process comprising the steps of:

arranging a counterpart electrode in the first housing portion in such a way that there is a predetermined spacing in the axial direction between the top side of the counterpart electrode and the edge of the first housing portion;

laying a diaphragm associated with the counterpart electrode over the edge of the housing portion;

arranging the edge of the diaphragm to be folded over the edge of the first housing portion;

fixing the folded-over edge at the outside of the first housing portion; and arranging the second housing portion as a cap or sleeve over the first housing portion.

13. The a process as set forth in claim 12, wherein the edge of the diaphragm is folded over by a sleeve which is of a slightly larger inside diameter than the outside diameter of the first housing portion.

* * * * *